United States Patent [19]

Baba

[11] Patent Number: 4,838,538

[45] Date of Patent: Jun. 13, 1989

[54] SHEET MATERIAL POSITIONING APPARATUS

[75] Inventor: Kiyokazu Baba, Komatsu, Japan

[73] Assignee: Kabushiki Kaisha Komatsu Seisakusho, Tokyo, Japan

[21] Appl. No.: 130,873

[22] PCT Filed: Mar. 20, 1987

[86] PCT No.: PCT/JP87/00175

§ 371 Date: Nov. 12, 1987

§ 102(e) Date: Nov. 12, 1987

[87] PCT Pub. No.: WO87/05589

PCT Pub. Date: Sep. 24, 1987

[30] Foreign Application Priority Data

Mar. 20, 1986 [JP] Japan ..... 61-39955[U]

[51] Int. Cl.[4] ..... B65H 9/04

[52] U.S. Cl. ..... 271/238

[58] Field of Search ..... 271/236, 238, 240

[56] References Cited

U.S. PATENT DOCUMENTS 3,408,140 10/1968 Hemphill ..... 271/238 X 4,493,412 1/1985 Krehnovi ..... 271/236 X

FOREIGN PATENT DOCUMENTS 57-85285 5/1982 Japan .

1544452 12/1976 United Kingdom .

*Primary Examiner*—Richard A. Schacher

*Attorney, Agent, or Firm*—Ronald P. Kananen

[57] ABSTRACT

The sheet material positioning apparatus according to the present invention comprises a pair of left and right side guides (11, 11) mounted so that they may be moved freely and independently with each other in the direction at right angles to the sheet material feeding direction and turned freely independently with each other in a horizontal plane; a pair of left and right front gauges (12, 12) and a pair of left and right rear gauges (13, 13), said front and rear gauges being mounted in the front and rear positions in the sheet material feeding direction so that they may be moved freely and independently with each other in the sheet material feeding direction and also in the vertical direction. Thus, adjusting independently the side guides (11, 11), the front gauges (12, 12) and the rear gauges (13, 13) by moving them individually, centering and positioning of sheet materials of any desired shapes can be achieved.

1 Claim, 5 Drawing Sheets

SHEET MATERIAL POSITIONING APPARATUS

TECHNICAL FIELD OF THE INVENTION

This invention relates to a sheet material centering and positioning apparatus adapted to be located between a destacker and a press machine and adapted to supply sheet materials conveyed by the destacker one by one to the press machine for working.

BACKGROUND TECHNIQUE OF THE INVENTION

When feeding the sheet material conveyed by the stacker into the press machine, it is necessary to correspond the centre or a predetermined point of the sheet material with the centre of the press machine and correspond the position of the sheet material with the stroke of feed thereof to the press machine. To achieve this, a sheet material positioning apparatus has so far been located between the destacker and the press machine.

For example, as disclosed in Japanese Patent Publication No. 54-11190, Japanese Utility Model Application Laid-open Specification No. 57-11635, Japanese Patent Application Laid-open Specification No. 59-24537, and further in Japanese Patent Application Laid-open Specification No. 61-38725, etc., a sheet material positioning apparatus is known which comprises a body frame having a pair of side guides, at least a front gauge and at least a rear gauge mounted, respectively, on the body frame, the arrangement being made such that the centering of a sheet material is made by these pair of side guides to correspond the centre of the sheet material with that of the press machine and the position of the sheet material in the feeding direction is controlled by the front and rear gauges.

Such a conventional sheet material positioning apparatus has been disadvantageous in that, since the above-mentioned pair of side guides are disposed oppositely and in parallel relationship in the direction at right angles to the sheet material feeding direction and arranged to be moved towards and away from each other, the sheet materials which can be subjected to centering are limited only to those whose both side surfaces in the feeding direction are parallel, and therefore centering of sheet materials of various configurations can not be made.

SUMMARY OF THE INVENTION

The present invention has been made in view of the above-mentioned situation of the conventional apparatus and has for its object to provide a sheet material positioning apparatus which enables centering and positioning of sheet materials of any shapes in the feeding direction to be achieved.

To achieve the above-mentioned object, according to the present invention, there is provided a sheet material positioning apparatus comprising a body frame; at least each one pair of skid bars on the left and right sides, respectively, each pair consisting of a plurality of skid bars extending longitudinally in the sheet material feeding direction and mounted on said frame in parallel with each other so that each pair may be moved freely up and down; at least a pair of left and right front gauges mounted on said frame so that they may be moved freely and independently with each other in the sheet material feeding direction and also in the vertical direction so as to receive the leading end of the sheet material in the feeding direction thereof; at least a pair of left and right rear gauges mounted on said frame so that they may be moved freely and independently with each other in the sheet material feeding direction and also in the vertical direction so as to abut against the trailing end of the sheet material in the feeding direction thereof thereby achieving the positioning of the sheet material; and at least a pair of left and right side gauges mounted oppositely on said frame so that they may be moved freely and independently with each other towards and away from each other in the direction at right angles to the sheet material feeding direction, characterized in that said pair of side guides are mounted in such a manner that they can be turned freely and independently with each other in a horizontal plane.

Further, according to the present invention, there is provided a sheet material positioning apparatus, characterized in that the left and right combinations each comprising one of said pairs of skid bars, one of said pair of front gauges and one of said pair of rear gauges are mounted on a pair of left and right auxiliary frames, respectively, said pair of auxiliary frames being mounted on said frame so that they may be moved freely and independently with each other in the direction at right angles to the sheet material feeding direction.

The above-mentioned and other advantages, manner and object of the present invention will be apparent to those skilled in the art by referring to the following description taken in conjunction with the accompanying drawings in which a preferred embodiment according to the principle of the present invention is shown by way of example only.

DESCRIPTION OF THE BEST MODE OF THE INVENTION

A preferable embodiment of the present invention will be described below with reference to the accompanying drawings.

In the following description, "the left and right" means the left and right direction when viewed from the sheet material feeding direction (i.e., the direction shown by an arrow in FIG. 1); that is to say, the direction at right angles to the sheet material feeding direction, whilst "front and rear" means the front and rear sides in the sheet material feeding direction.

Figure 1:
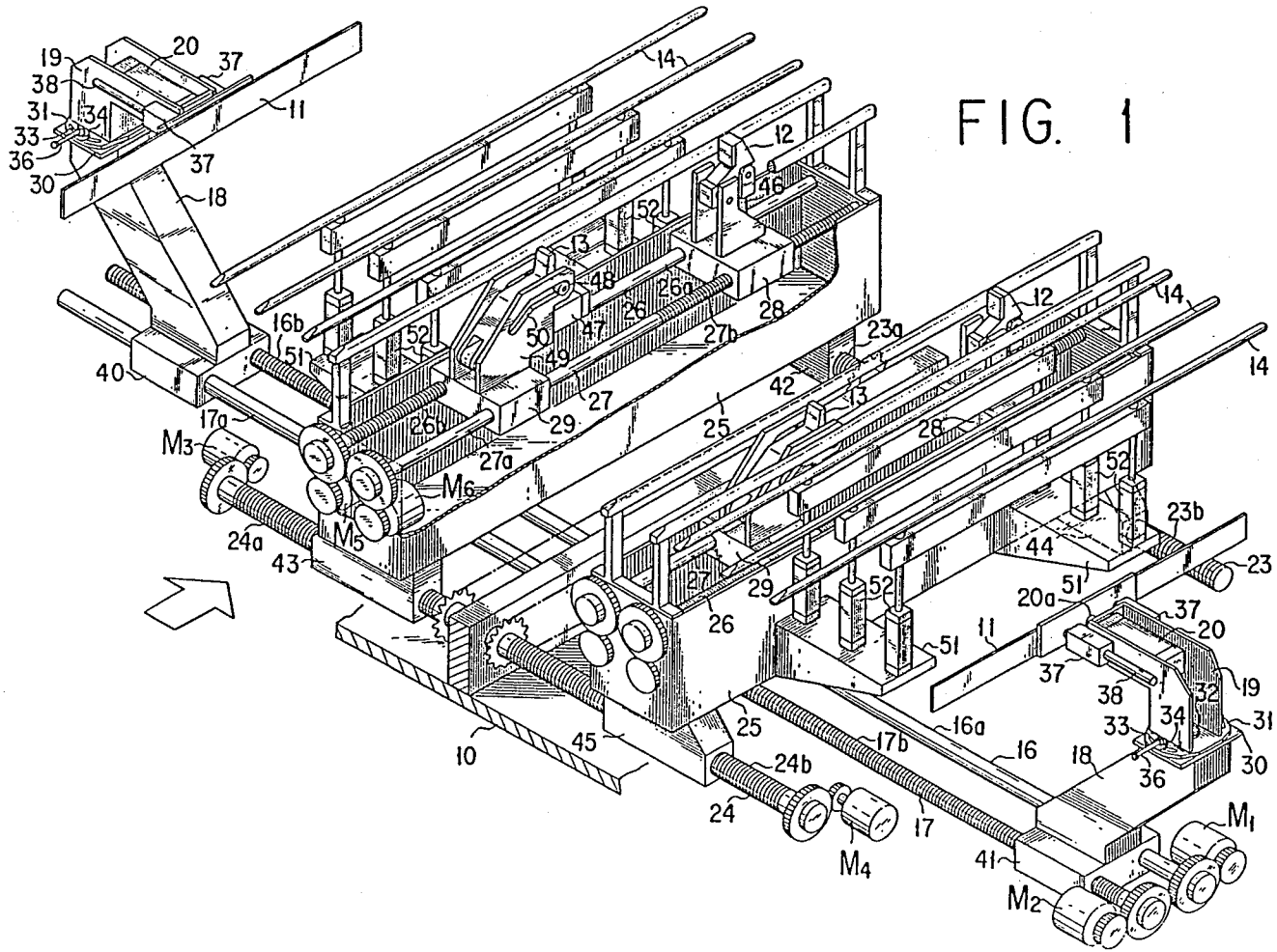
FIG. 1 is a schematic perspective view showing the whole arrangement of a suitable embodiment of sheet material positioning apparatus of the present invention.
Figure 2:
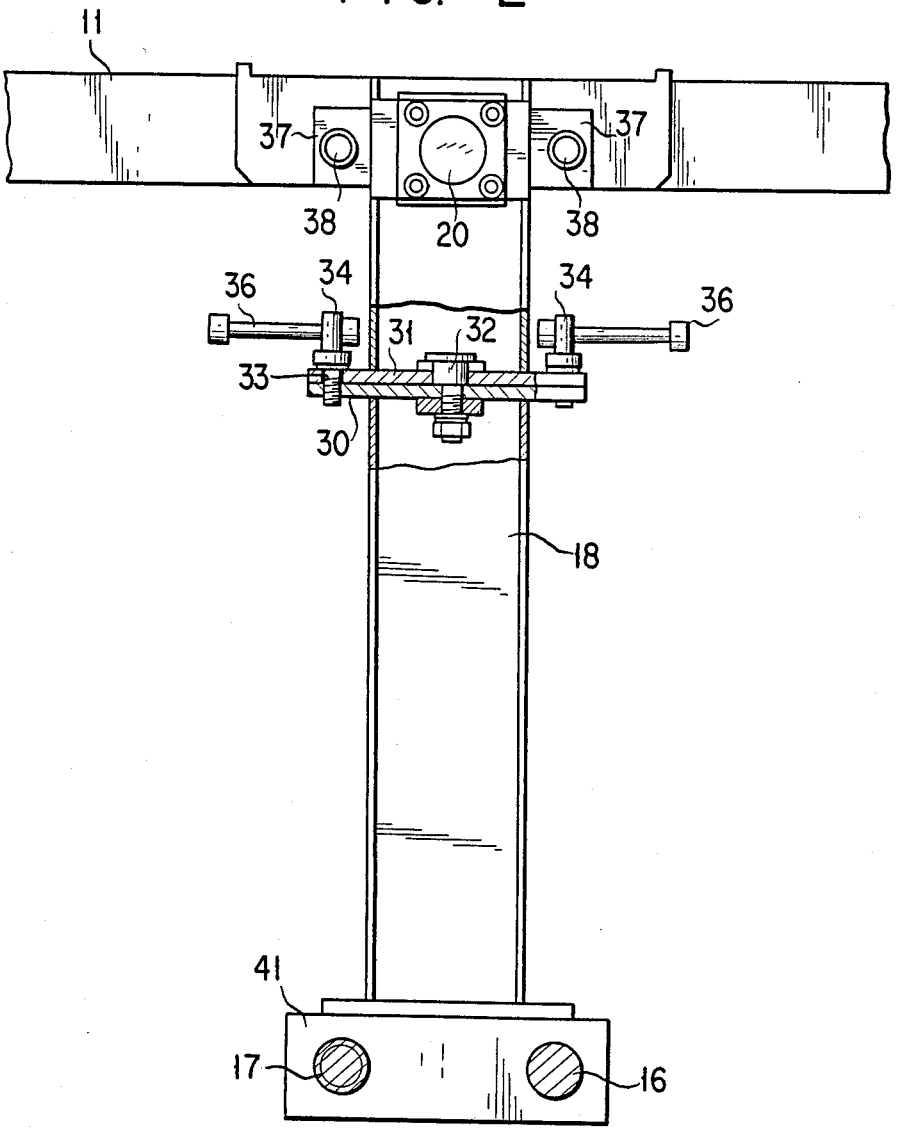
FIGS. 2 and 3 are schematic front view and schematic plan view, respectively, of the side guide fitting portion of the sheet material positioning apparatus shown in FIG. 1.
Figure 3:
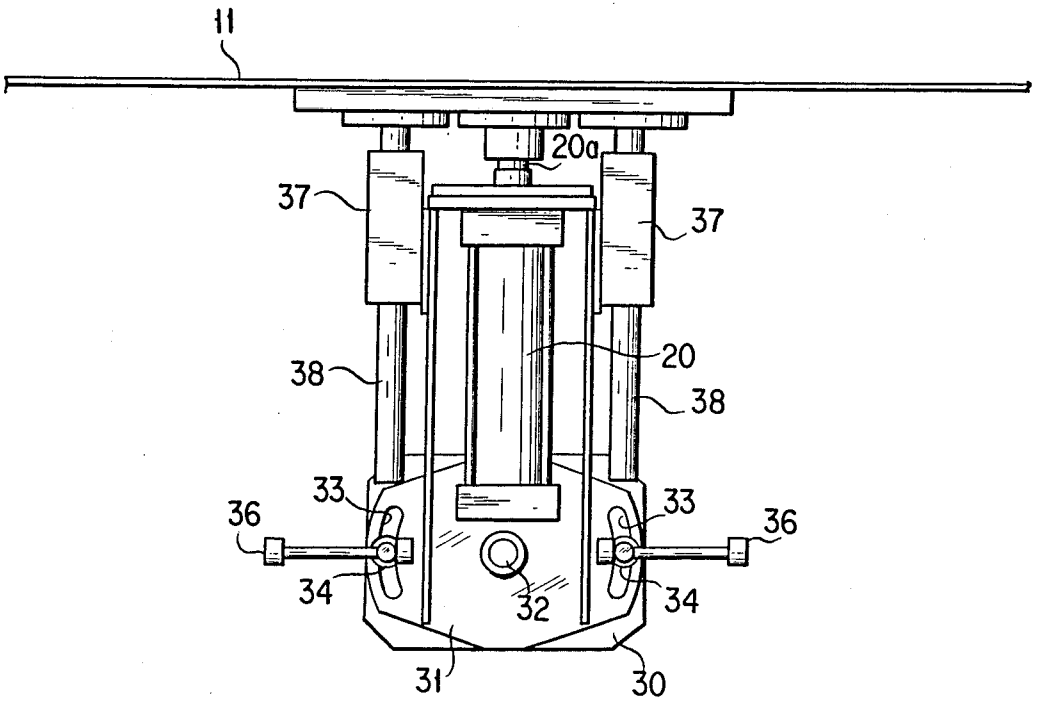
Figure 4:
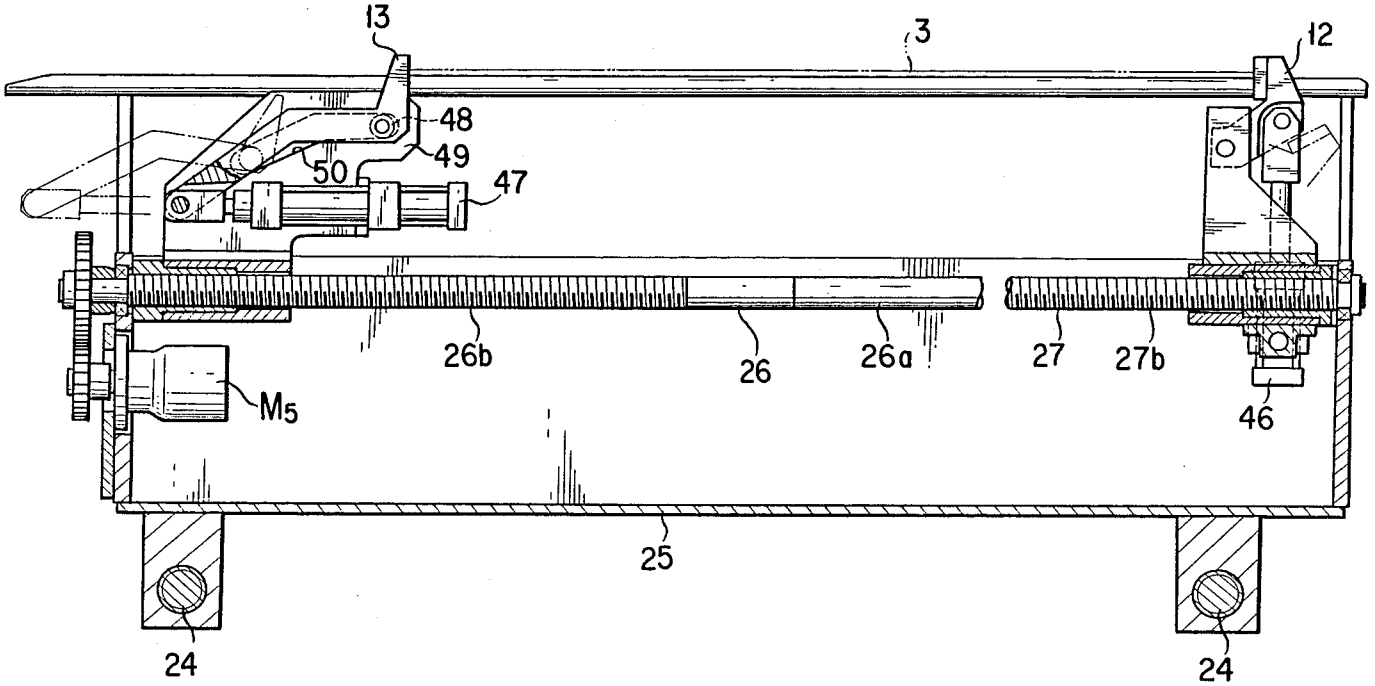
FIG. 4 is a schematic longitudinal sectional view of the front and rear gauge fitting portions of the sheet material positioning apparatus shown in FIG. 1, and FIGS. 5 and 6 are schematic explanatory views showing the operation of the sheet material positioning apparatus of the present invention.

In FIG. 1 which is an overall schematic perspective view, the sheet material positioning apparatus is comprised of a body frame 10 on which are mounted at least a pair of left and right side guides 11, 11; at least a pair of front gauges 12, 12 and at least a pair of rear gauges 13, 13, and at least each one pair of skid bars on the left and right sides, pair comprising a plurality of skid bars 14.

The pair of left and right side guides 11, 11 are located oppositely in the direction at right angles to the sheet material feeding direction as shown by the arrow and mounted so that they may be moved independently towards and away from each other in the direction at right angles to the sheet material feeding direction. The pair of left and right front gauges 12, 12 located on the front side in the sheet material feeding direction are freely movable independently with each other in the sheet material feeding direction and in the vertical direction so as to receive the leading edge of the sheet material conveyed from a destacker (not shown). Further, the pair of left and right rear gauges 13, 13 are also freely movable independently with each other in the sheet material feeding direction and in the vertical direction so as to abut against the trailing end of the sheet material resting on the sheet material positioning apparatus in the sheet material feeding direction thereby positioning the sheet material in the aforementioned direction.

The above-mentioned construction will now be described in more detail with reference to FIGS. 1 to 4.

Front and rear rod members 16 and 17 extend transversely and are supported between brackets, not shown, fixedly secured to the left and right sides of the intermediate portion of the frame 10 in the front and rear direction. A pair of left and right movable units 18 and 18 are carried or supported by the front and rear rod members 16 and 17. Each of the movable units 18 is provided with a horizontally freely rotatable body 19. The body 19 has a hydraulic cylinder 20 which is fixedly secured thereto and whose movable portion 20*a* is fixedly secured to the side guide 11.

The above-mentioned frames 10 has front and rear brackets, not shown, fixedly secured thereto in opposed relationship on the left and right sides of both ends thereof in the front and rear direction. The front and rear brackets have front and rear feed screw-threaded rods 23 and 24 supported transversely between them. A pair of left and right auxiliary frames 25 are carried or supported by the front and rear feed screw-threaded rods 23 and 24. Further, each of these auxiliary frames 25 has a fist rod member 26 and a second rod member 27 supported thereby transversely in the sheet material feeding direction. The first and second rod members 26 and 27 on each of the auxiliary frames 25 have a pair of front and rear blocks 28 and 29 which are supported thereon and to which the above-mentioned front and rear gauges 12 and 13 are mounted, respectively, so that they may be freely moved up and down and (rotated freely).

An upper cross plate 30 is fixedly secured to the upper part of the above-mentioned movable unit 18, and the body 19 is mounted on a lower cross plate 31 by means of a pin 32 so that the cross plate may be freely rotated in the horizontal plane. The lower cross plate 31 is formed with an arcuate groove 33 whose centre registers with the centre of the pin 32. A bolt 34 inserted through the arcuate groove 33 is threadably engaged with the threaded hole 35 formed in the upper cross plate 30. The bolt 34 is provided with a handle 36. When the bolt 34 has been loosened by turning the handle 36, the body 19 can be turned horizontally so that the side guide 11 may be turned horizontally.

Guide rods 38 inserted through a pair of guide bushes 37 of the above-mentioned body 19 are fixedly secured to the side guide 11, and when the movable portion 20*a* of the cylinder is extended and retracted, the side guide 11 is moved inwards and outwards.

The above-mentioned front and rear rod members 16 and 17 comprise guide rod portions 16*a*, 17*a* connected integrally with feed screw portions 16*b*, 17*b*, respectively. A left nut member 40 threadably engaged with the feed screw portion 16*b* of the front rod member 16 is slidably fitted to the guide rod portion 17*a* of the rear rod member 17, whilst a right nut member 41 threadably engaged with the feed screw portion 17*b* of the rear rod member 17 is slidably fitted to the guide rod portion 16*a* of the front rod member 16. The above-mentioned pair of left and right movable units 18 are fixedly secured to the left and right nut members 40 and 41, and the front and rear rod members 16 and 17 are connected with front and rear motors $M_1$ and $M_2$, respectively. By driving the front and rear motors $M_1$ and $M_2$ independently, the pair of movable units 18 can be moved independently with each other to the left and right so that the left and right side guides 11 can be moved independently to the left and right.

The above-mentioned front and rear feed screwthreaded rods 23 and 24 comprise first screw threaded rods 23*a*, 24*a* and second screw threaded rods 23*b*, 24*b* respectively, which are connected through respective sprocket-chain units to enable relative rotation of each of the pairs to be made. The left auxiliary frame 25 extends transversely on and fixedly secured to the left, front and rear nut members 42 and 43 threadably engaged with the first front and rear screw-threaded rods 23*a* and 24*a*, respectively, whilst the right auxiliary frame 25 extends transversely on and fixedly secured to the right, front and rear nut members 44 and 45 threadably engaged with the second front and rear screw-threaded rods 23*b* and 24*b*. The first front screw-threaded rod 23*a* is connected with a first motor $M_3$, whilst the second rear screw-threaded rod 24*b* is connected with a second motor $M_4$. Thus, by driving the first and second motors $M_3$ and $M_4$ independently, the left and right auxiliary frames 25 can be moved to the left and right independently from each other. By this arrangement, the left and right pairs or combinations each comprising the front and rear gauges 12 and 13 can be moved independently to the left and right.

The above-mentioned first and second rod members 26 and 27 comprise guide rod portions 26*a*, 27*a* and feed screw portions 26*b*, 27*b* connected integrally therewith, respectively. The front block 28 is carried or supported by the guide rod portion 26*a* of the first rod member 26 and the feed screw portion 27*b* of the second rod member 27, whilst the rear block 29 is carried by the feed screw portion 26*b* of the first rod member 26 and the guide rod portion 27*a* of the second rod member 27. The first and second rod members 26 and 27 are connected with third and fourth motors M5 and M6, respectively, and can be moved independently to the front and rear.

The above-mentioned front gauge 12 can be moved upwards and downwards by means of a cylinder 46, whilst the rear gauge 13 can be moved to the front and rear by means of a cylinder 47. A guide roller 48 is fitted in a doglegged guide groove 50 formed in a bracket 49, and when the rear gauge 13 is move to the front and rear, the guide roller 48 is slidably moved along the guide groove 50. Thus, both the front and rear gauges 12 and 13 can be moved so as to project upwards and retract downwards.

Each of the above-mentioned skid bars 14 is mounted through a cylinder 52 onto a support arm 51 fixedly secured to the auxiliary frame 25 so that the skid bar 14 may be freely moved up and down. When the side guides 11 are moved towards and away from each other, the skid bars 14 are moved down so as not to interfere with the movement of the side guides.

The operation of the sheet material positioning apparatus having the above-mentioned construction will now be described hereinbelow.

To receive a sheet material 3 conveyed by a destacker, not shown, and resting on the sheet material positioning apparatus, the pair of left and right front gauges 12, 12 are projected upwardly in the first place, and the leading end of the sheet material 3 moving slidably on and along the skid bars 14 which are at their upwardly projected positions are allowed to abut against the front gauges 12 and stopped thereby. Subsequently, the piston rods in the cylinders 20 of the left and right side guides 11, 11 which have been previously moved to their predetermined positions which vary depending on the shape of the sheet material 3 are extended so as to allow the left and right side guides 11, 11 to abut against both the left and right sides of the sheet material 3 thereby effecting the centering of the latter. After that, the pair of left and right rear gauges 13, 13 are moved to their upper positions and further moved by means of the motor M5 in the feeding direction thereby positioning the sheet material 3 in the same direction. Thus, the centering and positioning of the sheet material 3 can be achieved.

Figure 5:
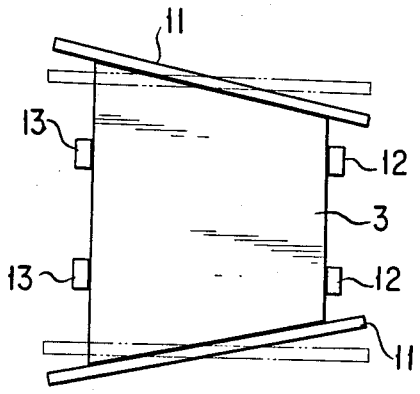

Further, if the angle of attachment of the pair of left and right side guides 11, 11 are changed to form a tapered configuration as shown in FIG. 5, centering of a sheet material of a trapezoidal shape can be achieved.

Furthermore, if the front and rear blocks 28 and 29 are moved towards and away from each other, the space interval between the front and rear gauges 12 and 13 can be regulated so that even a deformed sheet material 3 whose side lengths are different in the sheet feeding direction can be positioned readily.

Figure 6:
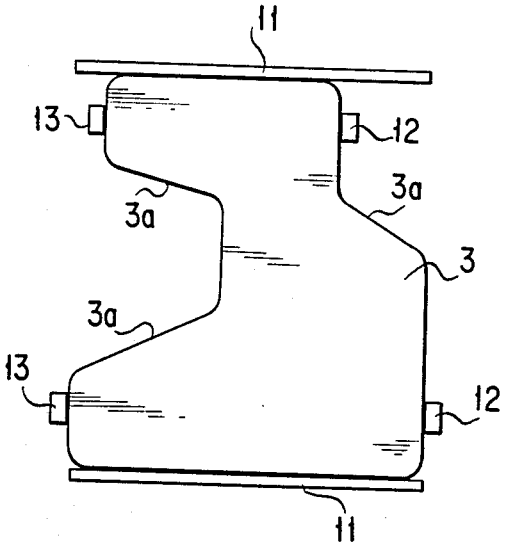

Still further, by moving the left and right auxiliary frames 25, 25 to the left and right as desired independently with each other, the pair of the left front and rear gauges 12 and 13 and another pair of the right front and rear gauges 12 and 13 can be moved to the left and right as desired. By effecting the adjustment of the pairs of gauges 12, 13, the abovementioned adjustment of the side guides, and the adjustment of the front and rear gauges by moving them to the front and rear, the centering and positioning of sheet materials of any desired shape can be achieved. For example, the centering and positioning of a U-shaped sheet material 3 having slanting surfaces **3*a* as shown in FIG. 6** can be accomplished.

It is to be understood that the foregoing example is merely a suitable embodiment of the present invention and that the scope of the present invention is not to be limited thereto, and those skilled in the art can think readily of many changes and modifications of the invention without departing from the scope of the present invention.

What we claim is:

1. A sheet material positioning apparatus comprising a body frame; at least each one pair of skid bars on the left and right sides, respectively, each pair of skid bars consisting of a plurality of skid bars extending longitudinally in the sheet material feeding direction and mounted on said frame in parallel with each other so that each pair may be moved freely up and down; at least a pair of left and right front gauges mounted on said frame so that they may be moved freely and independently with each other in the sheet material feeding direction and also in the vertical direction so as to receive the leading end of the sheet material in the feeding direction thereof; at least a pair of left and right rear gauges mounted ón said frame so that they may be moved freely and independently with each other in the sheet material feeding direction and also in the vertical direction so as to abut against the trailing end of the sheet material in the feeding direction thereof thereby achieving the positioning of the sheet material; and at least a pair of left and right side guides mounted oppositely, on said frame so that they may be moved freely and independently with each other towards and away from each other in the direction at right angles to the sheet material feeding direction, characterized in that said pair of side guides are mounted in such a manner that they can be turned freely and independently with each other in a horizontal plane, the left and right combinations each comprising one of said pair of skid bars, one of said pair of front gauges and one of said pair of rear gauges are mounted on a pair of left and right auxiliary frames, respectively, said pair of auxiliary frames being mounted on said frame so that they may be moved freely and independently with each other in the direction at right angles to the sheet material feeding direction.

* * * * *